US010974113B2

(12) United States Patent
Meadows et al.

(10) Patent No.: US 10,974,113 B2
(45) Date of Patent: Apr. 13, 2021

(54) BALL GAME SYSTEM AND METHOD OF PLAY

(71) Applicants: Dustin Haley Meadows, Panama City, FL (US); Morgan Slade Meadows, Panama City Beach, FL (US)

(72) Inventors: Dustin Haley Meadows, Panama City, FL (US); Morgan Slade Meadows, Panama City Beach, FL (US)

( * ) Notice: Subject to any disclaimer, the term of this patent is extended or adjusted under 35 U.S.C. 154(b) by 0 days.

(21) Appl. No.: 16/539,528

(22) Filed: Aug. 13, 2019

(65) Prior Publication Data

US 2020/0047044 A1 Feb. 13, 2020

Related U.S. Application Data

(60) Provisional application No. 62/718,152, filed on Aug. 13, 2018.

(51) Int. Cl.
*A63B 67/00* (2006.01)
*A63C 19/00* (2006.01)

(52) U.S. Cl.
CPC ..... *A63B 67/002* (2013.01); *A63C 19/00* (2013.01); *A63B 2243/0037* (2013.01)

(58) Field of Classification Search
CPC ..... A63B 67/002; A63B 2243/0037; A63C 19/00
USPC ..... 473/415, 422, 447, 465–479
See application file for complete search history.

(56) References Cited

U.S. PATENT DOCUMENTS 3,017,183 A * 1/1962 Chalcroft ..... A63B 63/083 473/483
3,050,304 A * 8/1962 Hulsebus ..... A63B 63/083 473/447
3,201,126 A * 8/1965 Nissen ..... A63B 5/11 473/478
3,601,401 A * 8/1971 Beck ..... A63F 3/00028 273/244.1
3,602,505 A * 8/1971 Friend ..... A63B 63/083 473/470
3,711,099 A * 1/1973 Milu ..... A63D 15/04 473/14
3,822,885 A * 7/1974 Domka ..... A63F 7/386 273/110
4,239,214 A * 12/1980 Brenner ..... A63B 63/083 273/342
4,266,763 A * 5/1981 Collins ..... A63B 63/083 473/481
4,335,881 A * 6/1982 Warehime ..... A63B 63/08 473/479

(Continued)

*Primary Examiner* — Mitra Aryanpour

(57) ABSTRACT

Disclosed is a method of playing a game. The method comprising providing a hexagon-shaped playing field with six boundary lines. Further, the method comprising providing a ball having the spherical shape similar to that of an American basketball. Further, the method comprising providing three baskets attached to three backboards attached to three poles, wherein each basket in the three baskets includes a net attached to a hoop, wherein each pole in the three poles is installed at three boundary lines in the six boundary lines respectively, wherein the three boundary lines are unconnected from each other. Further, the method comprising providing three teams of players comprising a first team of players associated with a first basket in the three baskets, a second team of players associated with a second basket in the three baskets and a third team of players associated with a third basket in the three baskets.

4 Claims, 1 Drawing Sheet

(56) References Cited

U.S. PATENT DOCUMENTS 4,762,319 A * 8/1988 Krumholz ..... A63B 63/08 473/416
5,072,947 A * 12/1991 Blue ..... A63B 43/00 473/479
5,615,890 A * 4/1997 Blue ..... A63B 59/80 473/469
6,068,558 A * 5/2000 Gill ..... A63D 15/00 473/18
6,299,570 B1 * 10/2001 Lim ..... A63B 21/00047 473/447
6,338,686 B1 * 1/2002 King ..... A63B 63/083 473/415
6,494,788 B1 * 12/2002 Gill ..... A63D 15/00 473/18
6,634,966 B2 * 10/2003 Gordon ..... A63B 5/11 473/415
6,669,583 B1 * 12/2003 Deppen ..... A63B 67/002 473/415
6,692,385 B2 * 2/2004 Walker, Jr. ..... A63B 69/0071 473/447
7,311,617 B2 * 12/2007 Langhorn ..... A63B 63/00 473/446
7,608,000 B2 * 10/2009 Butler ..... A63B 24/00 473/415
9,498,679 B2 * 11/2016 Homsi ..... A63B 24/0021 473/422
10,004,963 B2 * 6/2018 Crosby ..... A63B 63/083 473/476
2004/0214666 A1 * 10/2004 Dilling ..... A63B 63/00 473/470
2009/0069123 A1 * 3/2009 Nugent ..... A63B 24/0021 473/422
2020/0047044 A1 * 2/2020 Meadows ..... A63C 19/00 473/415

* cited by examiner

BALL GAME SYSTEM AND METHOD OF PLAY

The current application claims a priority to the U.S. Provisional Patent application Ser. No. 62/718,152 filed on Aug. 13, 2018.

FIELD OF THE INVENTION

The invention relates to a system and method for playing a game and more particularly to a new game with unique rules and scoring system incorporating many aspects of traditional American basketball.

BACKGROUND OF THE INVENTION

Ball games are quite popular across the world. People engage with various types of ball games such as bat-and-ball games, racquet-and-ball games, hand and ball-striking games, goal games and net games. However, ball games are often played between two teams. Further, many ball games were invented a long time ago. For example, basketball was invented in the late 1800s. Even though these games are popular, the audience may want to watch new ball games.

Therefore, there is a need for an improved game that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed is a method of playing a game. The method comprising providing a hexagon-shaped playing field with six boundary lines. Further, the method comprising providing a ball having the spherical shape similar to that of an American basketball. Further, the method comprising providing three baskets attached to three backboards attached to three poles, wherein each basket in the three baskets includes a net attached to a hoop, wherein each pole in the three poles is installed at three boundary lines in the six boundary lines respectively, wherein the three boundary lines are unconnected from each other. Further, the method may include providing three teams of players comprising a first team of players associated with a first basket in the three baskets, a second team of players associated with a second basket in the three baskets and a third team of players associated with a third basket in the three baskets, wherein each of the three teams having an objective to move the ball on the hexagon-shaped playing field and put the ball in a basket of an opposing team, wherein movement of said ball is accomplished by a player optionally 1) dribbling with said ball while moving in a given direction, 2) passing said ball to another player, wherein each of the three teams having an objective to defend their basket by stopping the movement of said ball by an opposing team toward their basket, whereby said movement may be stopped by players of the opposing team by either optionally 1) taking the ball from a player of the opposing team without making contact with the player and 2) disrupting a pass from one player of the opposing team to another.

According to some embodiments, a ball game is disclosed. The ball game comprising a hexagon-shaped playing field with six boundary lines. Further, the ball game comprising a ball having the spherical shape similar to that of an American basketball. Further, the ball game comprising three baskets attached to three backboards attached to three poles, wherein each basket in the three baskets includes a net attached to a hoop, wherein each pole in the three poles is installed at three boundary lines in the six boundary lines respectively, wherein the three boundary lines are unconnected from each other. Further, the ball game is played by three teams, wherein the three teams of players comprising a first team of players associated with a first basket in the three baskets, a second team of players associated with a second basket in the three baskets and a third team of players associated with a third basket in the three baskets, wherein each of the three teams having an objective to move the ball on the hexagon-shaped playing field and put the ball in a basket of an opposing team, wherein movement of said ball is accomplished by a player optionally 1) dribbling with said ball while moving in a given direction, 2) passing said ball to another player, wherein each of the three teams having an objective to defend their basket by stopping the movement of said ball by an opposing team toward their basket, whereby said movement may be stopped by players of the opposing team by either optionally 1) taking the ball from a player of the opposing team without making contact with the player and 2) disrupting a pass from one player of the opposing team to another.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
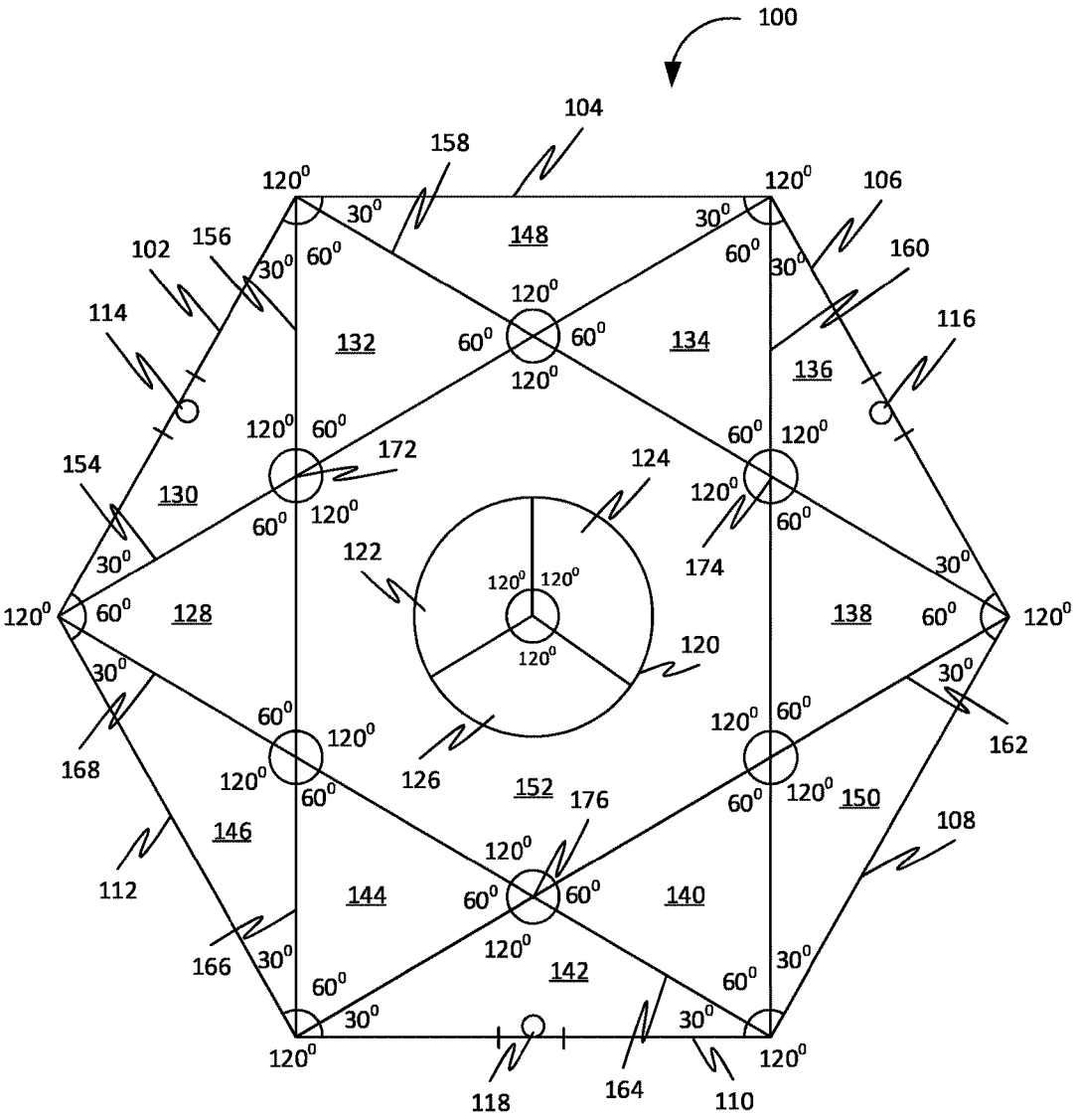
FIG. 1 is a plan view of a hexagon-shaped playing field for playing a ball game according to some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of ball games, embodiments of the present disclosure are not limited to use only in this context.

Overview

According to some embodiments, the present disclosure relates to a ball game. The ball game may be called "Starball". Further, the objective of ball game is to bring each of the opposing team's score to zero while the other players try to keep their team's score above zero. Any team whose score hits zero will be eliminated from the game, until one team remains. The last team remaining is the winner of the game. There is no time limit.

Beginning of the Game (Tip-Off):

Each team starts in their own section of the court. Each player from each team must start in the circle at the middle of the court, in the section that relates to the goal that team is defending. One player from each team will meet in the middle of the circle. Once each team is ready, a referee will blow a whistle signaling the start of the game. At this point, any player may choose to freely move about the court. After the whistle, the referee will throw the ball into the air, between the three players at the center of the circle. Each of the three players will compete to tip the ball in any direction.

Equipment and Court:

This game will utilize a size 29.5" standard basketball, and 3 10-foot-high standard basketball goals. Goals will be flush with the outer perimeter. The court will be played on a hexagonal court that measures 50 feet on each side, with a team's basket on every other side (equidistant from each other).

Rules, Regulations, and Officiating:

Deceased Ball:

In the event that a team scores, a foul or rule violation is committed, the ball goes out of bounds, or two or more players from opposing teams are grappling for the ball simultaneously for more than two seconds, the ball will be deemed "deceased." In the event of a deceased ball, one player from the team receiving possession begins with the ball in the proper inbounding area correlated to the cause of the deceased ball. This player must pass the ball within 5 seconds of the referee deeming the ball "alive." The player may not leave the inbounding area without passing the ball. To do so would result in a violation causing possession of the ball to defer to the next team up for possession on the Possession Wheel.

Possession Wheel:

The Possession Wheel is a tool utilized to decide which team receives possession of the ball in the event that the ball goes out of bounds, or two or more players grapple for the ball for more than two seconds. In the event of a foul or violation, the ball is administered to the correct team based on that foul, and the possession wheel is not used. The team who wins the tip-off will be rewarded with being the first team up for possession on the possession wheel. The team defending the basket to the right of the team who won tip-off will be the next on the Possession Wheel rotation, followed by the team to their right. Once the full rotation has happened, the rotation starts over with the team who won tip-off. In the event that the ball is sent out of bounds by Team A (Or B or C) while team A (Or B or C) is up for possession on the Possession Wheel, Team A (Or B or C) is skipped, and possession is deferred to whichever team is next on the Possession Wheel. In the event that a team's basket is scored on, the team defending that basket will receive possession of the ball starting underneath its own basket.

Dribbling:

The player possessing the ball must make a dribble every two steps. In the event the player in possession of the ball touches the ball with both hands, the player must stop their dribble. The player may then pass the ball or take a shot but cannot continue dribbling. In the event that a defender touches the ball without committing a foul, the player in possession may begin dribbling again. In the event that a player receives the ball while standing still, the player can pivot off of one foot while picking up and moving the other. The pivot foot cannot be moved unless the player begins dribbling the ball.

Scores:

Each of the three teams start with 50 points. Each team has a basket that they defend for the duration of the game. Points in this game go in a decreasing order. Each time a team's basket is scored on, the team scored on will lose two points. There are two different zones on the court which can be scored from: The Two-Point Zone, and the Recovery Zone. A basket made from the Two-Point Zone will result in the defending team's score decreasing by 2. (EXAMPLE: If team A has 34 points, and team C scores on their basket from the Two-Point Zone, team A now has 32 points. In the same way, if team B scores on team A from the Two-Point Zone, they also go from 34 to 32 points). In the event that a team scores a basket on an opposing team from inside the Recovery Zone, the team defending the basket will lose two points; however, the team who scored the basket will receive an additional (1) point to their score (EXAMPLE: If team A who has 32 points scores a basket on team B who has 32 points from inside the Recovery Zone, Team A's score will increase to 33 points, while team B's score will decrease to 30 points). In the event that a player passes the ball to another player that is airborne, and the player that receives the ball scores before his or her feet touch the ground, the score will be decided by where the player passing the ball's feet were located at the time of the pass. (EXAMPLE: Player A, from the Recovery Zone, passes the ball to Player B, who jumps from the Two-Point zone, and player B scores before his feet touch the ground. The shot will result in a Recovery Zone shot because Player A was the last player to have his feet on the ground and was in the Recovery Zone when he or she passed the ball).

Substituting:

Each team starts with three players on the court, making a total of 9 players on the court at all times. Substitutions can be made ONLY during the event of a deceased ball. There are no limitations to the number of substitutions each team can make during a game. Each team can have up to a maximum of nine players on their roster.

Fouls:

In the event a player touches the ball with his or her feet, the ball is declared deceased. Whichever player was handling the ball last before the event of a kicked ball will receive possession at the proper inbounding location UNLESS the player handing the ball commits the violation, or a player on the ball handler's team commits the violation, in which case the next team in rotation on the Possession Wheel receives possession UNLESS that team is the team in violation, in which case possession will be deferred to the next team in rotation on the Possession Wheel. Anything deemed by the referee as intentional or excessive kicked balls by a player or an entire team, that player or entire team will be administered a technical foul.

In the event a player violates the dribbling directive, the ball is declared deceased. Whichever team is next on the Possession Wheel receives possession, unless the player responsible for the violation belongs to the team up for possession. In this event, possession will be deferred to the next team up for possession on the Possession Wheel.

When defending the player dribbling the basketball, a player may not reach in with hands or arms and make contact with any part of the opposing player; only the ball. If the player reaches in and makes contact with the ball only, there is no foul.

When defending a player who is shooting the ball, the defender may not make contact with any part of the opposing player; only the ball.

Defensive/Off-the-ball Fouls:

When the offense is advancing the ball and makes notable contact with the defender, the defender's feet must be set in position before the moment of contact. If this occurs while the defender's feet are set, it will be an offensive foul (called on the player advancing the ball). If the defensive player's feet are NOT set when contact is made, this will result in a defensive foul called on that player.

An offensive player who does not have the ball may use his body to cut off a defender's path in order to create space for a teammate ONLY IF his or her feet are planted and his or her arms are not extended beyond his or her sides before any potential contact would be made. If the player's feet are moving, or his or her arms are extended beyond his or her sides, and contact is made with the defender, this will result in an offensive foul.

Goaltending:

When an offensive player shoots the ball, a defensive player has the opportunity to block that shot while the ball's arc is still going up. If a player makes contact with the ball while it is on the downward part of its arc, or after the ball has touched the backboard in result of a shot on goal, the defender has committed a goaltend. The team of the player who commits a goaltends score will decrease by two, depending on the Zone that the shot was taken from. In the event that a goaltend is committed on a shot from inside the Recovery Zone, the player who committed the foul's team's score will decrease by two, and the team of the player who shot the ball's score will increase by one. A player may not affect his or her own goal in the event of an opposing player taking a shot on his or her goal. This will result in a goaltend. This includes touching the rim of the basket, the backboard, or enforcing any contact that changes the physical state of the basket.

Foul Shots:

In the event that a player is fouled while in the act of shooting from inside the Two-Point Zone, that player will take two shots from the Recovery Zone against the team whose player committed the foul with an opportunity to decrease that team's score by one point per shot. In the event that a player is fouled while in the act of shooting from inside the Recovery Zone, that player will take three shots from the Recovery Zone against the team whose player committed the foul with an opportunity to decrease that team's score by two points (one point per shot). In the event the first two shots are made, the third shot will become a "Recovery Shot," granting the player shooting the opportunity to earn a point back to his or her team's total score. When attempting a foul shot, holding the ball in the Recovery Zone for more than ten seconds per shot according to the Referee will result in a Technical Foul for the player attempting the foul shot. If the last foul shot of a set is made, the team being shot on will receive possession underneath their basket. If the final shot is not made, the ball is alive. This rule does not apply to Technical, Excessive, or Overly Excessive Fouls. The game will be regulated by three officials.

Excessive Fouls:

An excessive foul is any foul committed with malicious intent and no indication of going for the ball or progressing the game. Two excessive fouls will result in an ejection. An overly excessive foul is a foul determined by the Referees to have so much malicious intent that it merits an immediate ejection. When a player, coach, etc. gets ejected, they must leave the premises for the duration of the game. The victim of the foul will take two shots from the Recovery Zone on the goal of the player in offense's team, with the opportunity to decrease that team's score by one point per shot. The player that was fouled receives possession after the shots are taken.

Technical Fouls:

A Technical Foul is determined by the Referee and is administered to players, coaches, etc. who display obvious misconduct and obstruct the progression of the game. When a team commits a technical foul, one player from each of the other two teams will take a shot from the Recovery Zone against the team in offense's basket with the opportunity to decrease that team's score by one point per shot. Whichever team had possession of the ball at the time of the technical foul will receive possession after the foul shots are taken.

Team Eliminations:

Once a team's score reaches zero, that team is eliminated from the game. When a team is eliminated from the game, that team's goal becomes inactive; however, their space of the court can still be utilized by the remaining teams. This game is made to be played in close-toed shoes.

Referring now to FIGURES, FIG. 1 is a plan view of a hexagon-shaped playing field 100 for playing a ball game according to some embodiments. The hexagon-shaped playing field 100 includes six boundary lines 102-112. For example, the length of each of the boundary lines in the six boundary lines 102-112 is 50 feet. The ball game may be played using a ball (not shown) having the spherical shape similar to that of an American basketball.

Further, three baskets 114-118 attached to three backboards (not shown) attached to three poles (not shown). Each basket in the three baskets 114-118 may include a net (not shown) attached to a hoop (not shown). Further, each pole in the three poles is installed at three boundary lines 102, 106, 110 in the six boundary lines 102-112 respectively. Further, the three boundary lines 102, 106, 110 are unconnected from each other.

Further, the ball game may be played by three teams of players comprising a first team of players associated with a first basket 114, a second team of players associated with a second basket 116 and a third team of players associated with a third basket 118. Further, each of the three teams may include three players.

Further, each of the three teams having an objective to move the ball on the hexagon-shaped playing field 100 and put the ball in a basket of an opposing team, wherein movement of said ball is accomplished by a player optionally 1) dribbling with said ball while moving in a given direction, 2) passing said ball to another player.

Further, each of the three teams having an objective to defend their basket by stopping the movement of said ball by an opposing team toward their basket, whereby said movement may be stopped by players of the opposing team by either optionally 1) tackling a player of the opposing team who is carrying said ball and 2) disrupting a pass from one player of the opposing team to another.

Further, the hexagon-shaped playing field 100 may include a circular region 120 at the center of the hexagon-shaped playing field 100. For example, the radius of the circular region 120 may be 14 feet. Further, the circular region 120 may be divided into three sections 122-126 associated with the three teams respectively. Further, the three teams may start the game in their own section three sections 122-126. Further, one player from each team meets in the middle of the circular region 120. Further, a referee blows a whistle signaling the start of the game when the three teams are ready. Further, the referee throws the ball into the air between the three players at the center of the circular region 120 after the whistle. Thereafter, each of the three players compete to tip the ball in any direction, wherein the players of the three teams move freely about the hexagon-shaped playing field 100 after the whistle.

Further, the hexagon-shaped playing field 100 is divided into multiple zones 128-152. Further, the multiple zones 128-152 may include one or more two-point zones 128-144 and one or more recovery zones 146-152. The multiple zones 128-152 may be created by drawing lines 154-168 on the hexagon-shaped playing field 100. For example, the lines 154-168 may be painted on the hexagon-shaped playing field 100. FIG. 1 mentions angles between various lines 154-168 and the six boundary lines 102-112 according to an exemplary embodiment. The recovery zone 152 may have a hexagonal shape with six boundary lines. For example, the length of each boundary line of the six boundary lines of the recovery zone 152 may be 86.6 feet.

Further, each of the three teams start the game with 50 points. Further, a team's score is decreased by two each time the team's basket is scored on by a player from an opposing team from a two-point zone in the one or more two-point zones 128-144. Further, a team's score is decreased by two each time the team's basket is scored on by a player from an opposing team from a recovery zone in the one or more recovery zones 146-152 and a score of the opposing team is increased by one.

Further, once a team's score reaches zero, that team is eliminated from the game. When a team is eliminated from the game, that team's goal becomes inactive; however, their space of the court can still be utilized by the remaining teams. Further, the last team remaining is the winner of the game.

Further, in the event that a player of a team passes the ball to another player of the team that is airborne, and the player that receives the ball scores before his or her feet touch the ground, the score is decided by where the feet of the player passing the ball were located at the time of the pass.

Further, when an offensive player shoots the ball towards a basket in the three baskets 114-118 and a defensive player (from an opposing team to the team of the offensive player) makes contact with the ball while at least one of the ball is on the downward part of its arc and after the ball has touched the backboard attached to the basket, the defensive player commits a goaltend. Accordingly, the score of the team of the defensive player who commits a goaltends is decreased by two if the shot was taken from a two-point zone in the one or more two-point zones 128-144. Alternatively, the score of the team of the defensive player who commits a goaltends is decreased by two if the shot was taken from a recovery zone in the one or more recovery zones 146-152 and the score of team of the offensive player is increased by one.

Further, in the event that a player is fouled while in the act of shooting from inside a two-point zone in the one or more two-point zones 128-144, then the player takes two shots from a recovery zone in the one or more recovery zones 146-152 against the team whose player commits the foul with an opportunity to decrease that team's score by one point per shot. Further, in the event that a player is fouled while in the act of shooting from inside a recovery zone in the one or more recovery zones 146-152, the player takes three shots from the recovery zone against the team whose player committed the foul with an opportunity to decrease that team's score by one point per shot with a maximum of two points. Further, in the event the first two shots are made, the third shot becomes a recovery shot, granting the player shooting the opportunity to earn a point back to their team's total score. Further, when attempting a foul shot, holding the ball in a recovery zone in the one or more recovery zones 146-152 for more than ten seconds per shot results in a technical foul for the player attempting the foul shot. Further, if the last foul shot of a set is made, the team being shot on receives the possession underneath their basket, wherein if the final shot is not made, the ball is alive.

Further, a player possessing the ball must make a dribble every two steps. Further, when the player in possession of the ball touches the ball with both hands, the player must stop their dribble and then perform at least one of pass the ball and take a shot.

Further, when at least one of a team scores, a foul is committed, the ball goes out of bounds, and two or more players from opposing teams grapple for the ball simultaneously for more than two seconds is detected, the ball is deemed as deceased. Further, in the event of a deceased ball, one player from the team receiving possession begins with the ball outside the boundary line of the hexagon-shaped playing field 100 in a proper inbounding area correlated to the cause of the deceased ball, wherein the player throws the ball into the hexagon-shaped playing field 100 within 5 seconds of the referee deeming the ball alive.

Further, a possession wheel is utilized to decide which team receives possession of the ball when at least one of the ball goes out of bounds, or two or more players grapple for the ball for more than two seconds is detected. For example, the possession wheel may be mechanical apparatus installed near the hexagon-shaped playing field 100. Further, the team that wins a tip-off is rewarded with being the first team up for possession on the possession wheel, wherein the team defending the basket to the right of the team that won tip-off is next on the possession wheel rotation, followed by the team to their right, wherein once the full rotation has happened, the rotation starts over with the team who won tip-off.

Further, the line 154 and the line 166 intersect at a point 172. The shortest distance between the point 172 and the boundary line 102 may be 14.4 feet. Further, the line 158 and the line 160 intersect at a point 174. The shortest distance between the point 174 and the boundary line 106 may be 14.4 feet. Further, the line 162 and the line 164 intersect at a point 176. The shortest distance between the point 176 and the boundary line 110 may be 14.4 feet.

According to some embodiments, a ball game disclosed. The ball game includes a hexagon-shaped playing field 100 with six boundary lines 102-112. Further, the ball game includes a ball having the spherical shape similar to that of an American basketball.

The ball game includes three baskets 114-118 attached to three backboards (not shown) attached to three poles (not shown). Further, each basket in the three baskets 114-118 includes a net (not shown) attached to a hoop (not shown). Further, each pole in the three poles is installed at three boundary lines 102, 106, 110 in the six boundary lines 102-112 respectively. Further, the three boundary lines 102, 106, 110 are unconnected from each other.

Further, the ball game is played by three teams. Each of the three teams may include three players. Further, the three teams of players comprising a first team of players associated with a first basket 114, a second team of players associated with a second basket 116 and a third team of players associated with a third basket 118. Further, each of the three teams having an objective to move the ball on the hexagon-shaped playing field 100 and put the ball in a basket of an opposing team, wherein movement of said ball is accomplished by a player optionally 1) dribbling with said ball while moving in a given direction, 2) passing said ball to another player, wherein each of the three teams having an objective to defend their basket by stopping the movement of said ball by an opposing team toward their basket, whereby said movement may be stopped by players of the opposing team by either optionally 1) taking the ball from a player of the opposing team without making contact with the player and 2) disrupting a pass from one player of the opposing team to another.

Further, the hexagon-shaped playing field 100 includes a circular region 120 at the center of the hexagon-shaped playing field 100. Further, the circular region 120 is divided into three sections 122-126 associated with the three teams respectively. Further, the three teams start the game in their own section of the circular region 120. Further, wherein one player from each team meets in the middle of the circular region 120. Further, a referee blows a whistle signaling the start of the game when the three teams are ready. Further, the referee throws the ball into the air between the three players at the center of the circular region 120 after the whistle. Further, each of the three players compete to tip the ball in any direction. Further, players of the three teams move freely about the hexagon-shaped playing field 100 after the whistle.

Further, the hexagon-shaped playing field 100 is divided into multiple zones 128-152. Further, the multiple zones

128-152 comprise at least one of one or more two-point zones 128-144 and one or more recovery zones 146-152.

Further, each of the three teams start the game with 50 points. Further, a team's score is decreased by two each time the team's basket is scored on by a player from an opposing team from a two-point zone in the one or more two-point zones 128-144. Further, a team's score is decreased by two each time the team's basket is scored on by a player from an opposing team from a recovery zone in the one or more recovery zones 146-152 and a score of the opposing team is increased by one.

Further, once a team's score reaches zero, that team is eliminated from the game. Further, when a team is eliminated from the game, that team's goal becomes inactive; however, their space of the court can still be utilized by the remaining teams, wherein the last team remaining is the winner of the game.

Further, in the event that a player of a team passes the ball to another player of the team that is airborne, and the player that receives the ball scores before his or her feet touch the ground, the score is decided by where the feet of the player passing the ball feet were located at the time of the pass.

Further, the ball game comprises a possession wheel (not shown) that may be utilized to decide which team receives possession of the ball when at least one of the ball goes out of bounds, or two or more players grapple for the ball for more than two seconds is detected. Further, the team that wins a tip-off is rewarded with being the first team up for possession on the possession wheel. Further, the team defending the basket to the right of the team that won tip-off is next on the possession wheel rotation, followed by the team to their right. Further, once the full rotation has happened, the rotation starts over with the team who won tip-off.

According to some embodiments, the players of the ball game try to bring the opposing team's score to zero while the other players try to keep their team's score above zero.

Although the present disclosure has been explained in relation to its preferred embodiment, it is to be understood that many other possible modifications and variations can be made without departing from the spirit and scope of the disclosure.

What is claimed is:

1. A ball game comprising:

a hexagon-shaped playing field;

the hexagon-shaped playing field comprising a first boundary line, a second boundary line, a third boundary line, a fourth boundary line, a fifth boundary line, a sixth boundary line, a first vertex, a second vertex, a third vertex, a fourth vertex, a fifth vertex, a sixth vertex, a first inner line, a second inner line, a third inner line, a fourth inner line, a fifth inner line, a sixth inner line and an inner circular line;

the first boundary line and the second boundary line intersecting at the first vertex;

the second boundary line and the third boundary line intersecting at the second vertex;

the third boundary line and the fourth boundary line intersecting at the third vertex;

the fourth boundary line and the fifth boundary line intersecting at the fourth vertex;

the fifth boundary line and the sixth boundary line intersecting at the fifth vertex;

the sixth boundary line and the first boundary line intersecting at the sixth vertex;

the first inner line being connected in between the first vertex and the fifth vertex;

the second inner line being connected in between the first vertex and the third vertex;

the third inner line being connected in between the second vertex and the sixth vertex;

the fourth inner line being connected in between the second vertex and the fourth vertex;

the fifth inner line being connected in between the third vertex and the fifth vertex;

the sixth inner line being connected in between the fourth vertex and the sixth vertex;

the inner circular line being surrounded by the first inner line, the second inner line, the third inner line, the fourth inner line, the fifth inner line and the sixth inner line;

a ball having the spherical shape similar to that of an American basketball;

three baskets attached to three backboards attached to three poles, wherein each basket in the three baskets includes a net attached to a hoop, wherein each pole in the three poles is installed at three boundary lines in the first boundary line, the second boundary line, the third boundary line, the fourth boundary line, the fifth boundary line and the sixth boundary line respectively, wherein the three boundary lines are unconnected from each other;

wherein the ball game is played by three teams, wherein the three teams of players comprising a first team of players associated with a first basket in the three baskets, a second team of players associated with a second basket in the three baskets and a third team of players associated with a third basket in the three baskets, wherein each of the three teams having an objective to move the ball on the hexagon-shaped playing field and put the ball in a basket of an opposing team, wherein movement of said ball is accomplished by a player optionally 1) dribbling with said ball while moving in a given direction, 2) passing said ball to another player, wherein each of the three teams having an objective to defend their basket by stopping the movement of said ball by an opposing team toward their basket, whereby said movement may be stopped by players of the opposing team by either optionally 1) taking the ball from a player of the opposing team without making contact with the player and 2) disrupting a pass from one player of the opposing team to another.

2. The ball game of claim 1 wherein the hexagon-shaped playing field includes a circular region at the center of the hexagon-shaped playing field, wherein the circular region is divided into three sections associated with the three teams respectively, wherein the three teams start the game in their own section of the circular region, wherein one player from each team meets in the middle of the circular region, wherein a referee blows a whistle signaling the start of the game when the three teams are ready, wherein the referee throws the ball into the air between the three players at the center of the circle after the whistle, wherein each of the three players compete to tip the ball in any direction, wherein players of the three teams move freely about the hexagon-shaped playing field after the whistle.

3. The ball game of claim 1 wherein the hexagon-shaped playing field is divided into multiple zones, wherein the multiple zones comprise at least one of at least one two-point zone and at least one recovery zone.

4. The ball game of claim 1 further comprising a possession wheel is utilized to decide which team receives possession of the ball when at least one of the ball goes out of bounds, or two or more players grapple for the ball for more than two seconds is detected, wherein the team that wins a tip-off is rewarded with being the first team up for possession on the possession wheel, wherein the team defending the basket to the right of the team that won tip-off is next on the possession wheel rotation, followed by the team to their right, wherein once the full rotation has happened, the rotation starts over with the team who won tip-off.

* * * * *